US006648813B2

(12) United States Patent
Zilberman et al.

(10) Patent No.: US 6,648,813 B2
(45) Date of Patent: Nov. 18, 2003

(54) HEARING AID SYSTEM INCLUDING SPEAKER IMPLANTED IN MIDDLE EAR

(75) Inventors: Yitzhak Zilberman, Santa Clarita, CA (US); Joseph H. Schulman, Santa Clarita, CA (US)

(73) Assignee: Alfred E. Mann Foundation for Scientific Research, Valencia, CA (US)

( * ) Notice: Subject to any disclaimer, the term of this patent is extended or adjusted under 35 U.S.C. 154(b) by 277 days.

(21) Appl. No.: 09/882,496

(22) Filed: Jun. 15, 2001

(65) Prior Publication Data

US 2001/0053871 A1 Dec. 20, 2001

Related U.S. Application Data

(60) Provisional application No. 60/212,307, filed on Jun. 16, 2000.

(51) Int. Cl.[7] ..... H04R 25/00
(52) U.S. Cl. ..... 600/25; 607/57
(58) Field of Search ..... 600/25; 607/55–57; 181/130, 134, 135; 381/315, 318

(56) References Cited

U.S. PATENT DOCUMENTS 5,015,224 A * 5/1991 Maniglia ..... 600/25
5,411,467 A 5/1995 Hortmann et al.
5,498,226 A 3/1996 Lenkauskas
5,558,618 A * 9/1996 Maniglia ..... 600/25
5,654,530 A * 8/1997 Sauer et al. ..... 181/130
5,772,575 A 6/1998 Lesinski et al.
5,796,848 A * 8/1998 Martin ..... 381/316
5,906,635 A 5/1999 Maniglia
5,913,815 A 6/1999 Ball et al.
6,137,889 A * 10/2000 Shennib et al. ..... 181/134
6,198,971 B1 * 3/2001 Leysieffer ..... 607/55
6,216,040 B1 4/2001 Harrison
6,259,951 B1 7/2001 Kuzma et al.
6,272,382 B1 8/2001 Faltys et al.
6,275,596 B1 8/2001 Fretz et al.
6,308,101 B1 10/2001 Faltys et al.
6,387,039 B1 * 5/2002 Moses ..... 600/25
6,390,971 B1 * 5/2002 Adams et al. ..... 600/25
6,402,682 B1 * 6/2002 Johansson ..... 600/25
6,422,991 B1 * 7/2002 Jaeger ..... 600/25

* cited by examiner

*Primary Examiner*—Joseph Pelham
(74) *Attorney, Agent, or Firm*—Lee J. Mandell

(57) ABSTRACT

A system for enhancing a patient's hearing using electrically driven sound transducer, i.e., a speaker, implanted in the patient's middle ear cavity. More particularly, the speaker is implanted in the middle ear cavity inward of the tympanic membrane and oriented to direct sound energy toward the ossicles or the round window. In a first arrangement, the speaker functions to vibrate the ossicles and thus, via the oval window, actuate the perilymph in the cochlea. In an alternative arrangement, the speaker functions to actuate the cochlea via sound injected into the round window.

21 Claims, 4 Drawing Sheets

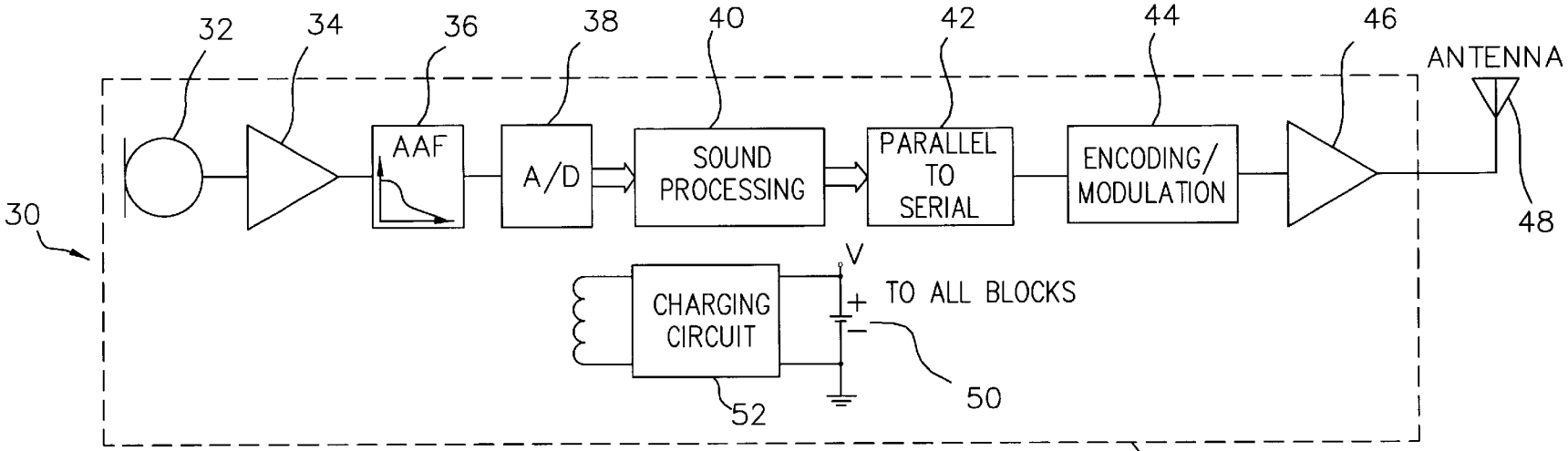
FIG. 4: MICROPHONE MODULE
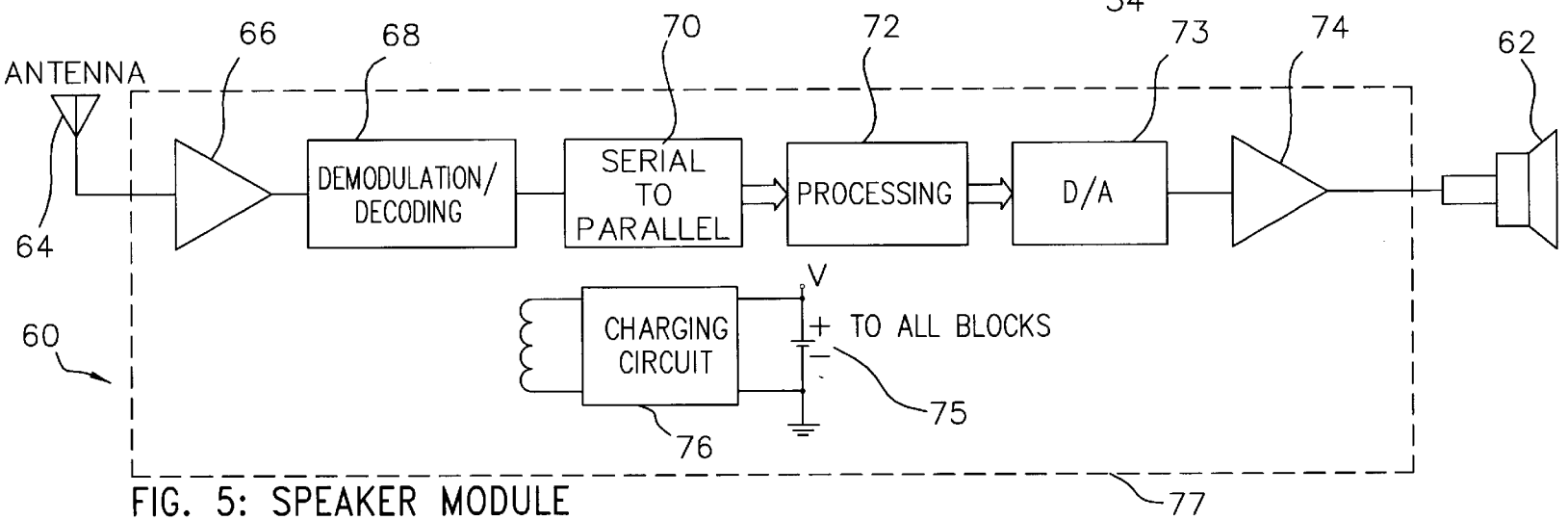
FIG. 5: SPEAKER MODULE

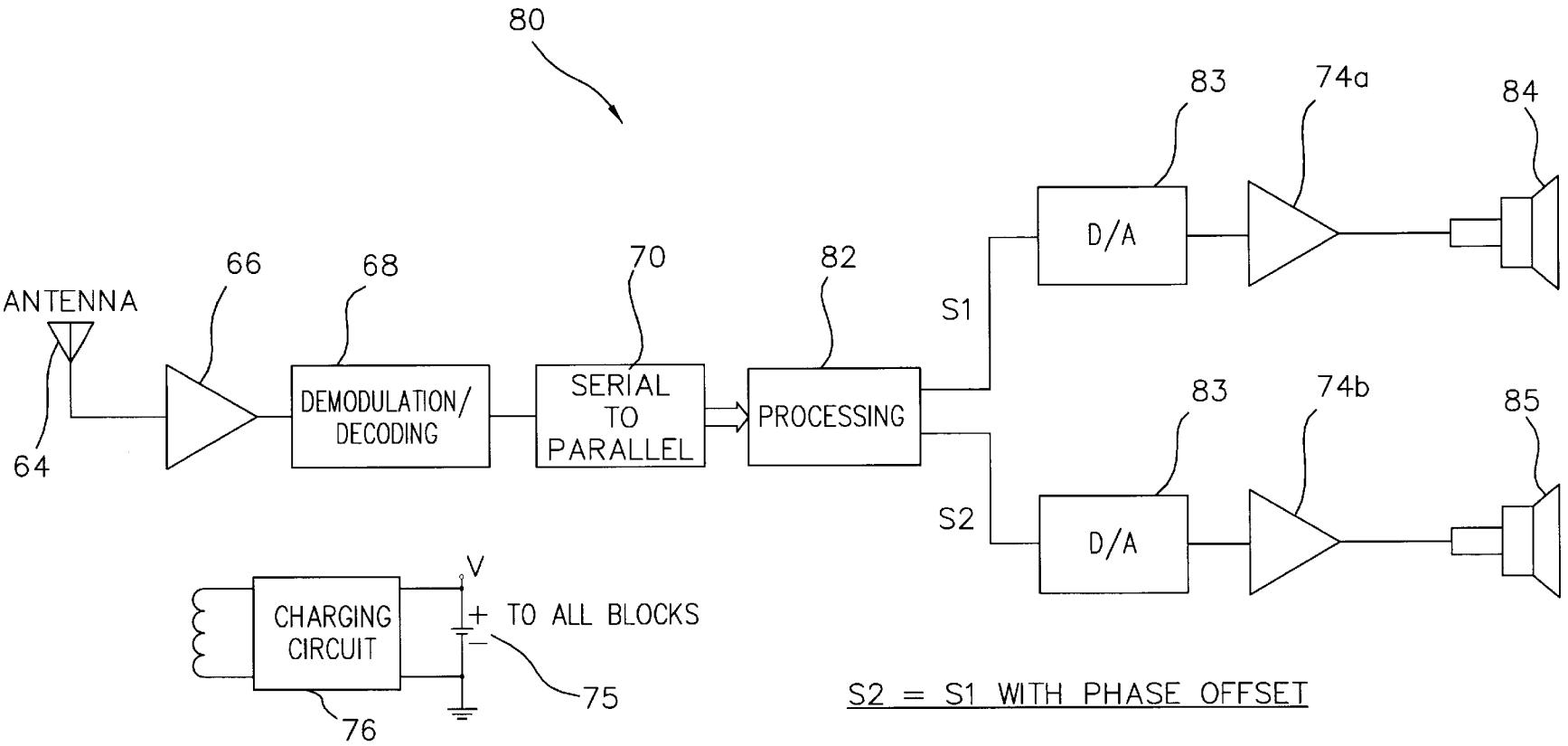
FIG. 6: SPEAKER MODULE

HEARING AID SYSTEM INCLUDING SPEAKER IMPLANTED IN MIDDLE EAR

RELATED APPLICATIONS

This application claims the benefit of U.S. Provisional Application 60/212,307 filed Jun. 17, 2000.

FIELD OF THE INVENTION

This invention relates generally to a system and method for enhancing hearing in patients suffering from sensorineural hearing deficiencies and more particularly to a system including an electrically driven speaker implanted adjacent the middle ear cavity.

BACKGROUND OF THE INVENTION

The prior art is replete with descriptions of various devices and techniques for enhancing hearing in patients suffering from sensorineural hearing deficiencies.

As an example, U.S. Pat. No. 5,913,815 contains an extensive description of the background of hearing aids and cites a multiplicity of prior patents and publications. For example, the '815 patent discusses that "The vibratory structures of the ear include the tympanic membrane, ossicles (malleus, incus, and stapes), oval window, round window, and cochlea. Each of the vibratory structures of the ear vibrates to some degree when a person with normal hearing hears sound waves. However, hearing loss in a person may be evidenced by one or more vibratory structures vibrating less than normal or not at all."

The '815 patent also mentions that "Various types of hearing aids have been developed to restore or improve hearing for the hearing impaired. With conventional hearing aids, sound is detected by a microphone, amplified using amplification circuitry, and transmitted in the form of acoustical energy by a speaker or another type of transducer into the middle ear by way of the tympanic membrane. Often the acoustical energy delivered by the speaker is detected by the microphone, causing a high-pitched feedback whistle. Moreover, the amplified sound produced by conventional hearing aids normally includes a significant amount of distortion."

In order to mitigate the aforementioned and other shortcomings of earlier devices and techniques, various efforts have been directed toward surgically implanting devices which produce vibrations by physical contact and before conduction.

SUMMARY OF THE INVENTION

The present invention is directed to a system which uses an electrically driven sound transducer, i.e., a speaker, implanted in the middle ear cavity. More particularly, in accordance with the invention, the speaker is implanted in the middle ear cavity inward of the tympanic membrane and oriented to direct sound energy toward the ossicles and thus, via the oval window, actuate the perilymph in the cochlea. In an alternative arrangement, the speaker functions to actuate the cochlea via sound injected into the round window.

Many prior art middle ear hearing aid devices rely on an actuator to physically vibrate one of the ear's components, typically one of the three ear bones (ossicles) or one of the cochlea membranes. Indeed, some devices require penetration of the cochlea. This level of invasiveness presents a risk of aggravating, rather than mitigating, hearing impairment. The present invention considerably reduces the risk by relying on sound energy, rather than physical contact.

In accordance with the invention, a microphone is supported and/or implanted adjacent to the ear canal sufficiently isolated from the implanted speaker. The microphone is configured to respond to sound energy to generate an electric signal which drives the implanted speaker which is preferably contained in a hermetically sealed housing fixed to bony material adjacent to the middle ear cavity.

In accordance with a preferred system embodiment, the microphone comprises a component of an integrated microphone module including an analog-to-digital converter, sound processing circuitry, and encoding/modulation transmitter circuitry, all contained in a hermetically sealed housing. The housing includes a battery, preferably a lithium ion battery, which can be charged from an external source, as by an alternating magnetic field source.

In accordance with a preferred embodiment, the speaker comprises a component of an integrated speaker module including demodulation/decoding receiver circuitry, processing circuitry, and a digital-to-analog converter, all contained in a hermetically sealed housing. The speaker module housing contains a battery similar to that contained in the microphone module.

In accordance with a preferred system embodiment, sound insulation is preferably provided to direct sound energy primarily to the ossicles and middle ear oval window and away from the microphone. In order to minimize signal cancellation which could occur by in-phase sound energy also entering the round window, it is preferable to seal the round window. This sealing can take the form of a passive sound insulator or an active device (e.g., a second speaker) which produces the same signal but out of phase.

In an alternative preferred embodiment, the speaker is mounted close to the round window and insulated to minimize sound transmission to the microphone and the oval window.

In accordance with a further aspect of a preferred embodiment, a speaker placed in one ear can be driven by a microphone placed in the other ear. This arrangement reduces feedback.

BRIEF DESCRIPTION OF THE DRAWINGS

FIG. 4 is a block diagram of a preferred microphone module in accordance with the present invention;

FIG. 5 is a block diagram of a preferred speaker module in accordance with the present invention; and FIG. 6 is a block diagram of an alternative speaker module for generating out-of-phase sound energy to reduce in-phase signal cancellation.

DETAILED DESCRIPTION OF THE PREFERRED EMBODIMENTS

Figure 1:
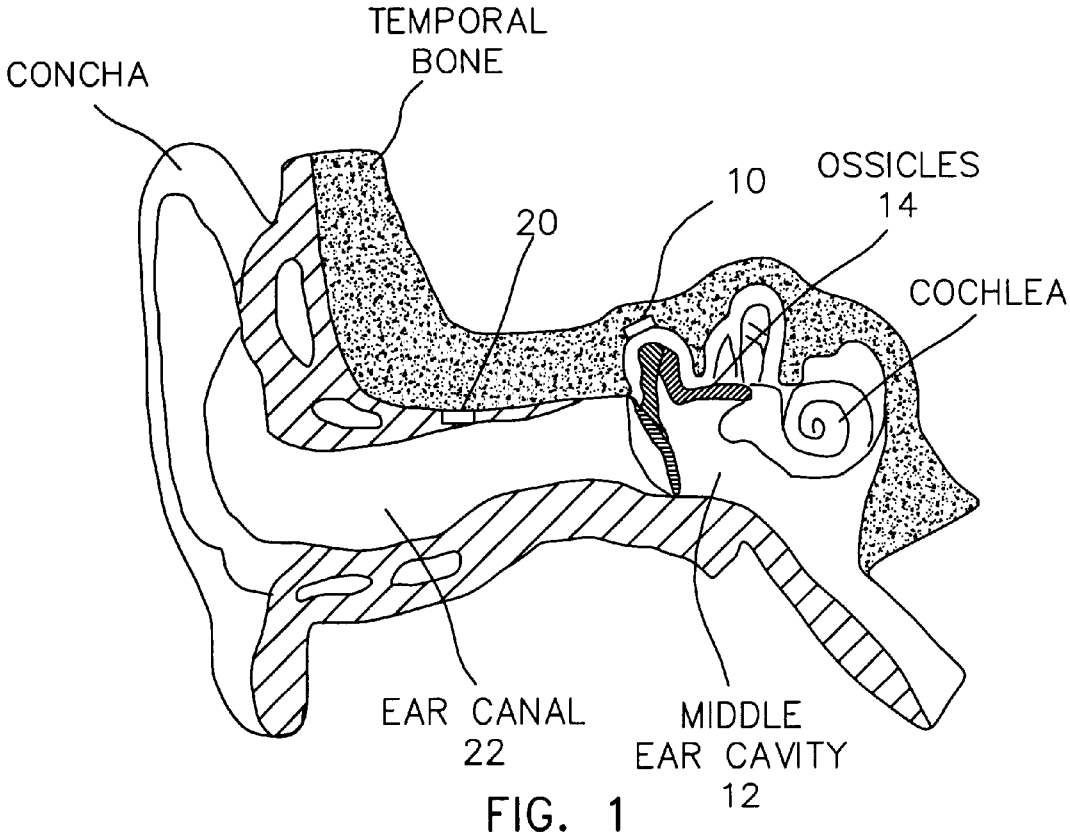
FIG. 1 schematically represents the internal structure of a typical ear showing an exemplary placement of a speaker and microphone in accordance with the present invention.

Attention is initially directed to FIG. 1 which schematically represents the internal structure of a typical ear. The internal ear structure is generally considered to be comprised of three portions, namely, the outer ear, the middle ear, and the inner ear. The outer ear is in part defined by the cochlea and the ear canal leading to the tympanic membrane. Across the tympanic membrane is the middle ear cavity defined essentially by the tympanic membrane and peripheral bony structure. The cavity contains three primary ear bones, i.e., the ossicles. The inner ear is comprised in large part by the cochlea and related structure.

In the operation of the healthy ear, sound enters the ear canal. At the tympanic membrane, sound energy (air pressure changes) is transformed into mechanical energy acting to vibrate the ossicles. The middle ear serves essentially as an impedance matching transformer, matching the impedance of air in the ear canal to the impedance of the perilymph of the inner ear. The ossicles couple mechanical energy to the perilymph in the cochlea primarily by way of the oval window.

In accordance with the present invention, an electrically driven speaker 10 is implanted adjacent to the middle ear cavity 12. FIG. 1 shows the speaker 10 in a superior placement fixed to bony structure defining the upper periphery of the cavity 12. The speaker 10 in a first arrangement is preferably oriented to direct sound energy to vibrate the ossicles 14. In an alternative arrangement, the speaker can be placed proximate to the round window (not shown) and oriented to direct its sound energy into the round window.

The speaker 10 is driven by a microphone 20 which is mounted adjacent to the ear canal 22. The microphone 20 is preferably subcutaneously implanted but may alternatively be placed above the skin within the ear canal. Two small isolated wires (not shown) can be provided to couple the microphone 20 to the speaker 10. However, as will be discussed hereinafter, it is far preferable for the microphone 20 to be physically associated with sound processing and RF transmitting circuitry in order to transmit radio signals to the speaker 10.

Figure 2:
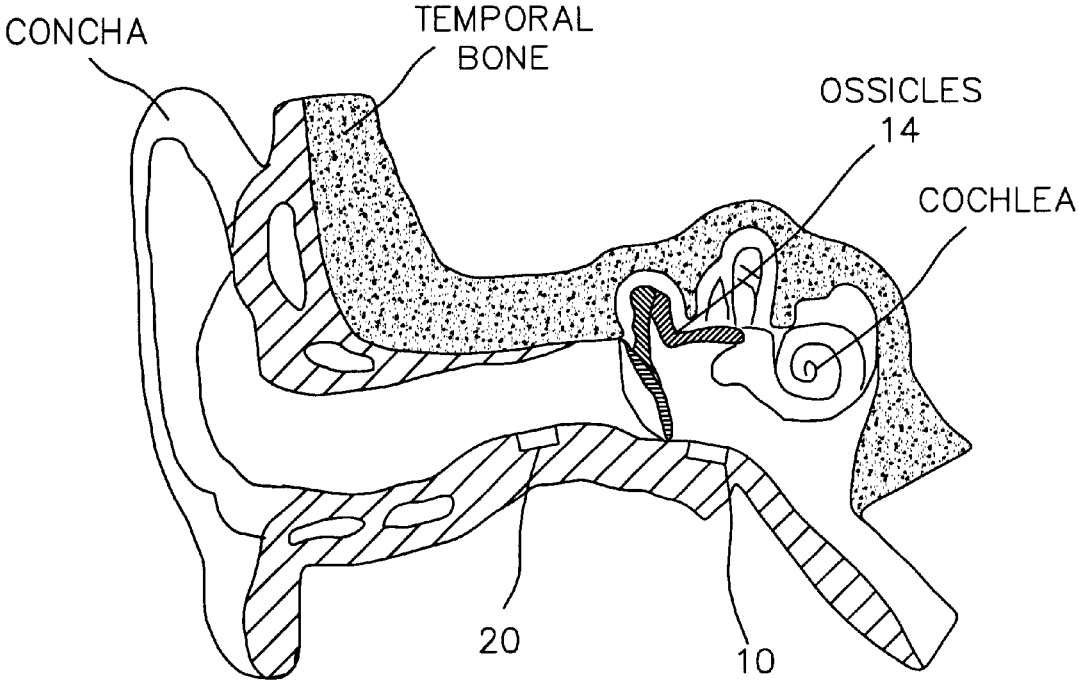
FIG. 2 is a schematic illustration similar to FIG. 1 but showing an alternative exemplary placement of a microphone and speaker in accordance with the invention.

Whereas FIG. 1 shows an exemplary superior placement of both the microphone 20 and speaker 10, FIG. 2 shows an alternative inferior placement of the microphone 20 and speaker 10. Although not shown, it is pointed out that the microphone and speaker need not be placed in the same relative position. That is, where appropriate, the speaker 10 can be placed in a superior position and coupled to a microphone 20 in an inferior position or vice versa.

Regardless of the precise placement of the speaker 10, the speaker is to be implanted adjacent to the middle ear cavity 12 to direct sound energy either to the ossicles 14 or to the round window (not shown). In either case, the sound energy is air conducted and neither the ossicles nor the round window are physically contacted by any actuator member. In both cases, it is preferable to use insulating material to restrict the sound energy to the intended target, e.g., the ossicles or round window.

Figure 3:
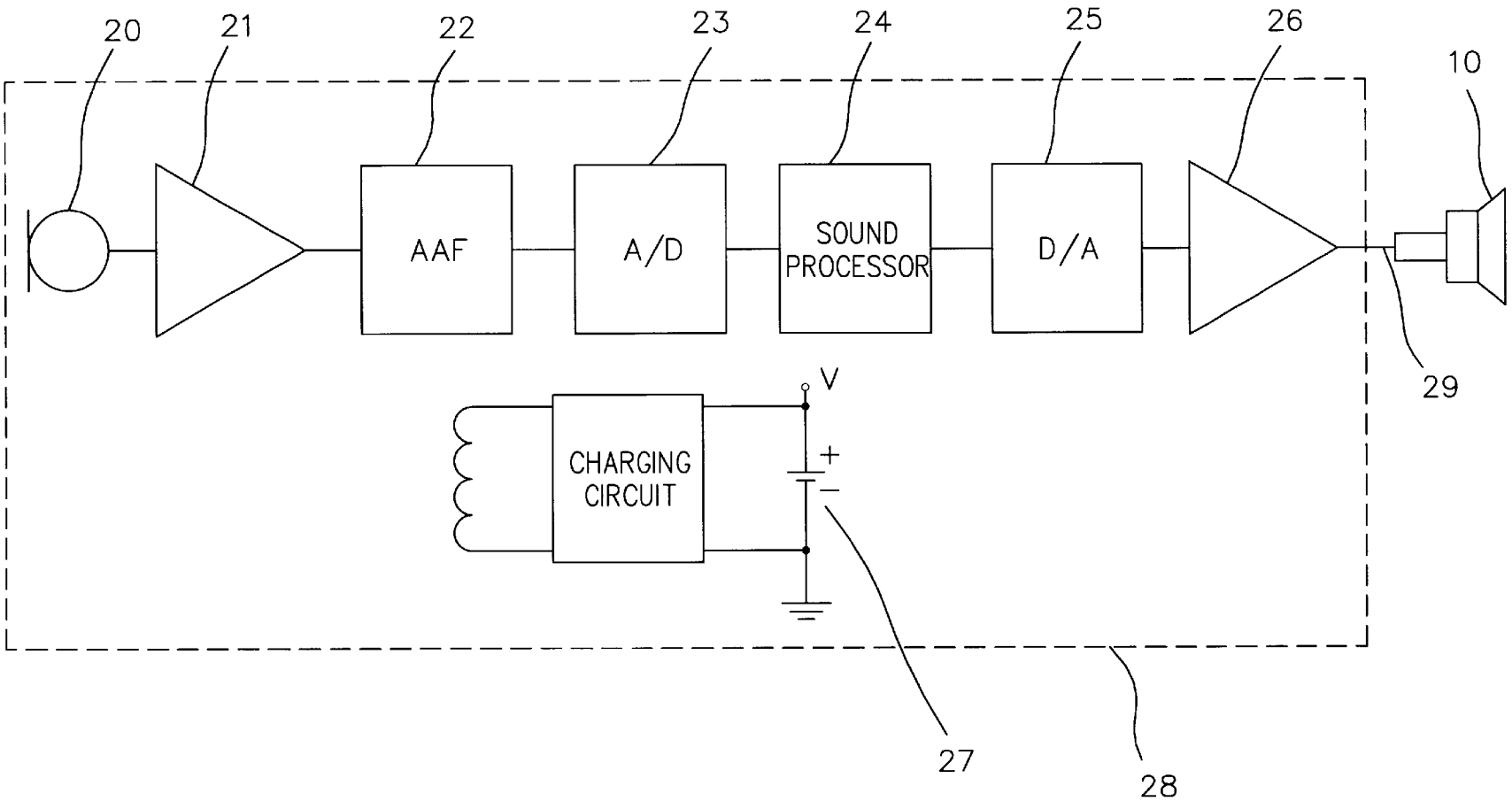
FIG. 3 is a block diagram of a first embodiment for coupling a microphone and speaker in accordance with the present invention.

Attention is now directed to FIG. 3 which depicts a first embodiment for connecting the microphone 20 to the speaker 10. The circuitry includes an amplifier 21, a filter 22, e.g., antialiasing, an analog-to-digital converter 23, a digital sound processor 24, a digital-to-analog converter 25, and an amplifier 26. All the blocks are preferably powered by a battery 27, e.g., a rechargeable lithium ion battery. All of the blocks depicted in FIG. 3, except for the speaker 10 are preferably contained in a hermetically sealed housing 28 and connected to speaker 10 by surgically placed wires 29.

Attention is now directed to FIG. 4 which illustrates a preferred microphone module 30 intended to be implanted as depicted in FIGS. 1 and 2. The module 30 is comprised of a microphone 32, an amplifier 34, a filter 36, e.g. antialiasing, an analog-to-digital converter 38, a digital sound processing circuit 40, a parallel to serial converter 42, and an encoding/modulating transmitter circuit 44. The output of the transmitter circuit 44 is coupled through amplifier 46 to an antenna 48. The blocks of the microphone module 30 depicted in FIG. 4 are all powered by a battery 50. The battery is preferably of the rechargeable type, e.g., a lithium ion battery, which can be charged by charging circuit 52 from, for example, energy extracted from an alternating magnetic field provided by an external source (not shown). All of the elements of FIG. 4 are preferably contained in a hermetically sealed housing 54 to be implanted adjacent the middle ear cavity, e.g., at the microphone sites depicted in FIGS. 1 and 2.

In use, sound energy detected by microphone 32 is, after filtering, converted to digital form and appropriately processed by a programmable sound processing circuit 40 to best mitigate the particular hearing impairment of the patient. The resulting digital signal produced by sound processing circuit 40 is then used to modulate RF carrier signal in circuit 44 which is then applied to antenna 48.

FIG. 5 depicts a preferred embodiment of speaker 10 comprising a speaker module 60 containing output speaker 62. Module 60 functions to receive the signal transmitted by antenna 48 to drive output speaker 62.

Speaker module 60 is comprised of an antenna 64 coupled via an amplifier 66 to a demodulation/decoding circuit 68. The output of circuit 68 is converted from serial to parallel form in block 70 and then processed in block 72 prior to being applied via converter 73 and amplifier 74 to drive speaker 62. All of the blocks in FIG. 5 are intended to be powered by a battery 75 and charging circuit 76, similar to aforementioned battery 50 and charging circuit 52. All of the elements of module 60 are contained in a hermetically sealed housing 77.

As previously mentioned, it is intended that the speaker 62 of FIG. 5 be mounted adjacent the middle ear cavity 12 directed toward the ossicles 14 as shown in FIGS. 1 and 2 or round window (not shown). If directed toward the ossicles. The speakers will vibrate the ossicles which will transfer mechanical energy via the oval window to the cochlea. In order to minimize noise and signal cancellation which could occur attributable to signal energy transfer via the round window, it is preferable to seal the round window. Sealing can be provided by a passive insulating material properly mounted adjacent the round window. Alternatively, a second speaker can be provided directed at the round window to emit the same signal as the primary speaker but of opposite phase. FIG. 6 illustrates an alternative speaker module 80 which is similar to the module 60 of FIG. 5 except that it requires the processing circuit 82 to generate identical out-of-phase signals S1 and S2. Signals S1 and S2, via D/A converters 83, respectively drive speakers 84 and 85. Speaker 84 can be the primary speaker as aforediscussed for driving the ossicles 14 to transfer energy through the oval window. Speaker 85 can be directed toward the round window to produce an out-of-phase sound signal which adds to, rather than cancels out the primary energy coupled to the cochlea.

In the discussion thus far, and as depicted in FIGS. 1 and 2, it has been assumed that the primary speaker in the middle cavity is driven by a microphone associated with the same ear. Although this arrangement can be satisfactorily implemented, it is subject to typical feedback limitations. That is, the microphone, as depicted in FIG. 1, could pick up sound energy from the speaker 10 depicted in FIG. 1.

Although in many situations this feedback may not present a major problem, it does limit the level of amplification which can be used. This feedback limitation can be significantly minimized when using RF communication as represented by the modules of FIGS. 4–6. Utilizing RF communication, it is now quite feasible to drive a speaker 10 in one ear from a microphone 20 placed in the opposite ear. That is, a left ear speaker can be driven by a right ear microphone via a first RF channel and a right ear speaker can be driven by a left ear microphone via a second RF channel.

From the foregoing, it should now be apparent that applicants have disclosed a system for improving the hearing of impaired persons by implanting an electrically driven speaker so as to generate sound energy in the middle ear cavity to vibrate the ossicles or round window by air conduction without physical contact.

What is claimed is:

1. A system for enhancing a patient's hearing capability, said system comprising:

a pair of spaced transducers individually responsive to phase offset electric drive signals for producing sound energy; and wherein said transducer is mounted adjacent to said patient's middle ear cavity for directing said produced sound energy into said cavity.

2. The system of claim 1 wherein at least one of said transducers is oriented to direct said produced sound energy to vibrate said patient's ossicles.

3. The system of claim 1 further including a microphone for producing electric output signals; and circuit means responsive to said electric output signals for producing said phase offset electric drive signals for individually driving said transducers.

4. The system of claim 3 wherein said transducers and said microphone are respectively oriented to avoid coupling sound energy from said transducers to said microphone.

5. The system of claim 3 including insulation material associated with said transducers for directing produced sound energy into said middle ear cavity and away from said microphone.

6. The system of claim 3 wherein said circuit means is hermetically sealed.

7. A system for aiding a patient to hear, said system comprising:

a pair of spaced speakers;

said speakers being implanted adjacent to said patient's middle ear cavity for directing phase offset sound energy into said cavity in response to phase offset electric drive signals individually applied to each of said speakers;

a microphone responsive to sound energy incident thereon for producing electric output signals; and circuit means responsive to said electric output signals for producing said phase offset electric drive signals for individually driving each of said speakers.

8. The system of claim 7 wherein said speakers and said microphone are respectively positioned to prevent sound energy produced by said speakers from being coupled to said microphone.

9. The system of claim 8 wherein said microphone is mounted adjacent to said patient's outer ear.

10. The system of claim 8 wherein said speakers are mounted adjacent to the middle ear cavity of said patient's first ear and said microphone is mounted adjacent to said patient's second ear.

11. The system of claim 7 including insulation material for directing sound energy produced by said speakers into said middle ear cavity and away from said microphone.

12. The system of claim 7 wherein at least one of said speakers is oriented for directing sound energy to vibrate said patient's middle ear ossicles.

13. The system of claim 7 wherein said circuit means includes wires connecting said microphone to said speakers.

14. The system of claim 7 wherein said circuit means includes RF transmitter/receiver circuitry for wirelessly coupling said microphone to said speakers.

15. The system of claim 7 wherein said circuit means includes microphone circuitry and speaker circuitry;

said microphone circuitry including analog-to-digital converter means for converting said microphone electric output signals and an RF transmitter for transmitting said converted output signals; and said speaker circuitry including an RF receiver for receiving said converted microphone output signals and first and second digital-to-analog converter means for converting said received signals to produce said phase offset drive signals for individually driving each of said speakers.

16. The system of claim 15 further including programmable sound processing circuitry in said microphone circuitry and/or said speaker circuitry for mitigating the particular hearing impairment of said patient.

17. The system of claim 7 including a rechargeable battery for powering said circuit means.

18. The system of claim 7 wherein said circuit means is hermetically sealed.

19. A method of enhancing a patient's hearing comprising:

mounting a pair of spaced transducers adjacent to said patient's middle ear cavity; and supplying phase offset electric drive signals to each of said transducers for introducing sound energy into said middle ear cavity.

20. The method of claim 19 wherein at least one of said transducers is oriented to direct sound energy to vibrate said patient's middle ear ossicles.

21. The method of claim 19 further including providing a microphone for producing electric output signals representative of sound incident on said microphone; and further including the step of processing said microphone output signals to produce said phase offset electric drive signals.

* * * * *